US007530935B2

(12) United States Patent
Marcantonio

(10) Patent No.: US 7,530,935 B2
(45) Date of Patent: May 12, 2009

(54) EXERCISING APPARATUS

(76) Inventor: Richard Marcantonio, 66 N. Broadway, Irvington, NY (US) 10533

( * ) Notice: Subject to any disclaimer, the term of this patent is extended or adjusted under 35 U.S.C. 154(b) by 0 days.

(21) Appl. No.: 11/982,911

(22) Filed: Nov. 6, 2007

(65) Prior Publication Data

US 2008/0161172 A1 Jul. 3, 2008

(51) Int. Cl.
*A63B 21/05* (2006.01)

(52) U.S. Cl. ..... 482/128; 482/904

(58) Field of Classification Search ..... 482/100–103, 482/904, 121–124, 51, 127–128, 140
See application file for complete search history.

(56) References Cited

U.S. PATENT DOCUMENTS 4,911,425 A * 3/1990 Kynast et al. ..... 482/54
4,936,573 A * 6/1990 Miller ..... 482/118
5,044,629 A * 9/1991 Ryan et al. ..... 482/101
5,048,827 A * 9/1991 Caruso ..... 482/73
5,100,128 A * 3/1992 Mabry et al. ..... 482/134
5,242,179 A * 9/1993 Beddome et al. ..... 280/233
5,643,143 A * 7/1997 Burak et al. ..... 482/54
5,697,628 A * 12/1997 Spear ..... 280/304.1
5,762,593 A * 6/1998 Whiteley ..... 482/134
6,334,624 B1 * 1/2002 Giglio ..... 280/304.1
7,125,365 B2 * 10/2006 Krietzman ..... 482/112

* cited by examiner

*Primary Examiner*—Fenn C Mathew
(74) *Attorney, Agent, or Firm*—Milde & Hoffberg, LLP

(57) ABSTRACT

An exercising apparatus designed to fit around a seat is provided. The exercising apparatus includes a frame that is adapted to be secured to the support. The frame is a U-shaped configuration with a lateral open area to receive the seat into the frame. One or more arms are coupled to the frame about one or more pivots. Further, the pivots allow a pivotal motion of each of the arms when a force is exerted thereto by a user. One or more first resistance devices coupled to the frame and the arms, which provide resistance to the pivotal motion of each of the arms.

23 Claims, 25 Drawing Sheets

PLAN VIEW

PLAN VIEW

FRONT VIEW

SIDE VIEW

SIDE VIEW I

SIDE VIEW 2

FRONT VIEW

PLAN VIEW

ARM (106a) FRONT VIEW

ARM SIDE VIEW (2) ARMS

GRIP (112a)
FRONT VIEW

GRIP (112a)
PLAN VIEW

GRIP (112a)
SIDE VIEW

SECTION 5

SECTION THRU BASE PLATE

SIDE VIEW

SIDE VIEW

SIDE VIEW

EXERCISING APPARATUS

BACKGROUND OF THE INVENTION

The present invention relates, in general, to an exercising apparatus. More specifically, the present invention relates to an exercising apparatus designed to fit around a seat.

Various types of exercising apparatus are known in the art that are intended for indoor use. Typically, an exercising apparatus includes a frame standing on a floor on which resistance delivery systems are attached and the resistance delivery systems provide resistance to a force applied by a user. Further, the frame has a seat or a bench attached to it on which the user may sit or lay down depending upon the exercise to be performed.

Conventional exercising apparatus with an attached seat is suitable to use for the intended exercise; however, such an exercising apparatus occupies large space. Moreover, a separate room or a large area is required for the exercising apparatus. Further, such exercising apparatus does not have provision for a user in a wheelchair to exercise without getting up out of the wheelchair.

In light of the foregoing, there is a need for an exercising apparatus that is easy to fit around an existing seat.

SUMMARY OF THE INVENTION

An object of the present invention is to provide an exercising apparatus that is designed to fit around a seat.

Another object of the present invention is to provide an exercising apparatus that is designed to fit around a toilet seat.

Another object of the present invention is to provide an exercising apparatus that is designed to receive a wheelchair.

Another object of the present invention is to provide a frame of an exercising apparatus that is designed to receive a seat.

Embodiments of the present invention provide an exercising apparatus designed to fit around a seat. In a first embodiment of the present invention, the seat is a toilet seat. The exercising apparatus includes a frame adapted to be attached to a support through one or more attachment devices. The support may be a wall or a base member or the seat. One or more arms are pivotally coupled to the frame through one or more pivots. The pivots allow a pivotal motion of each of the arms when a user exerts a directional force on the arms. The user may sit on the seat and exert the directional force on the arms. In another embodiment, the user may exert a directional force on the arms when standing.

One or more first resistance devices are attached to the frame and the arms. The first resistance devices provide resistance to the pivotal motion. The resistance may be increased or decreased based on the convenience of the user. The exercising apparatus includes one or more gripping handles that are releasably attached to each of the arms. One or more shafts protrude from the arms and are attached to the gripping handles. The shafts extend or retract based on a linear axial movement of the shafts with respect to the arms. The linear axial movement of the shafts provides proper hand positioning of the user during exercise. In addition, the exercising apparatus includes one or more second resistance devices inside the arms, which are attached to the shafts. Second resistance devices provide resistance to the linear axial movement.

In a second embodiment of the present invention, an exercising apparatus designed to receive a wheelchair is provided. The exercising apparatus includes a frame with a U-shaped configuration and a lateral open area to receive the wheelchair into the frame. The frame is mounted on a base and attached to a support. In a third embodiment of the present invention, a frame is secured to the base through a base plate. In this embodiment, the base plate receives the wheelchair and is secured in place on the base by the weight of the user.

Various embodiments of the present invention provide an exercising apparatus that is convenient to carry and occupies less space. The exercising apparatus includes a frame that is designed to receive a seat such as a wheelchair or a toilet seat or a chair. The seat serves as a seat for exercising apparatus. Moreover, the structure of the frame enables a user on a wheelchair to exercise without leaving the wheelchair.

For a full understanding of the present invention, reference should now be made to the following detailed description of the preferred embodiments of the invention as illustrated in the accompanying drawings.

DETAILED DESCRIPTION OF EMBODIMENTS OF THE INVENTION

Figure 1:
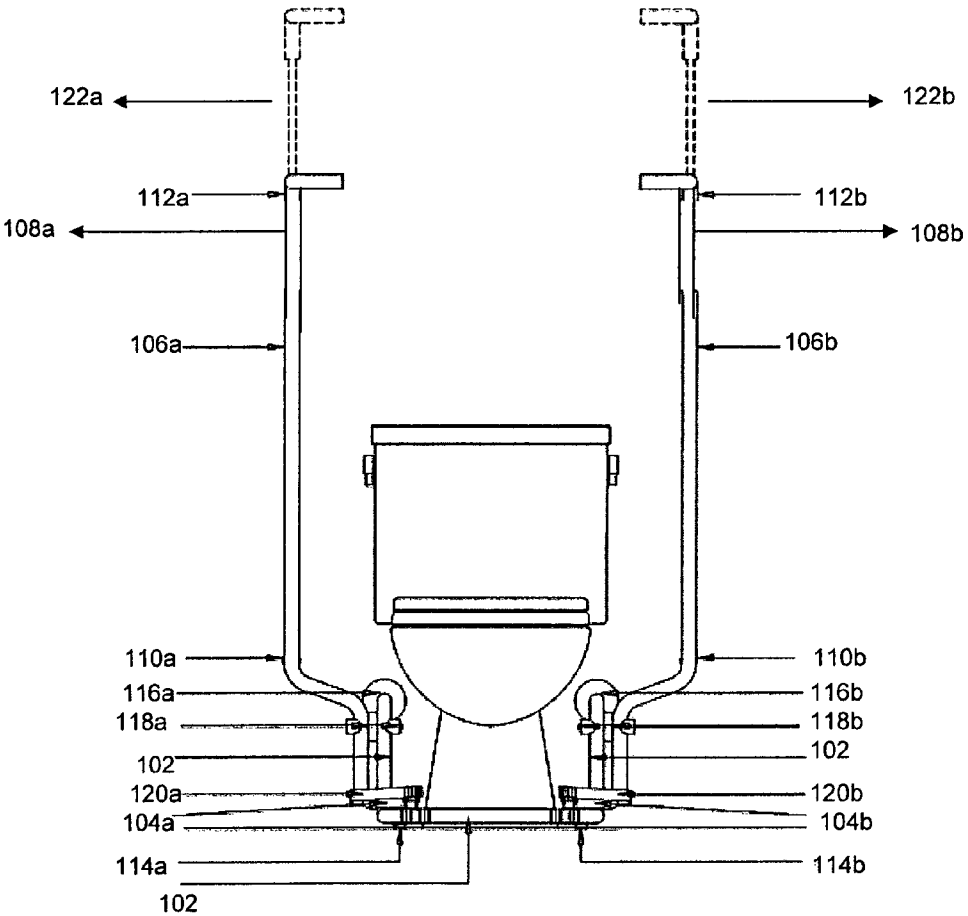
FIG. 1 illustrates a front view of an exercising apparatus, in accordance with a first embodiment of the present invention.

Embodiments of the present invention describe an exercising apparatus designed to fit around a seat. In the description herein for embodiments of the present invention, numerous specific details are provided, such as examples of components and/or mechanisms, to provide a thorough understanding of embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Embodiments of the present invention describe an exercising apparatus designed to fit around a seat. Various embodiments of the present invention provide an exercising apparatus that includes a frame, one or more arms and one or more resistance devices. The frame is secured to a support. The frame has a U-shaped configuration to receive a seat into the frame. The arms are pivotally coupled to the frame at one or more pivots. A pivotal motion is provided to each of the arms about the pivots with the frame, when a user exerts a directional force on the arms. The resistance devices are coupled to the frame and the arms and provide resistance to the pivotal motion.

Reference will now be made in detail to several embodiments of the invention that are illustrated in the accompanying drawings. Wherever feasible and convenient, same reference numerals are used in the FIGs and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings. These and similar directional terms should not be strictly construed to limit the scope of the invention. In addition, words such as couple, connect, and similar terms with their inflectional morphemes are used interchangeably, unless the difference is noted or made otherwise clear from the context. These words and expressions do not necessarily signify direct connections, but include connections through mediate components and devices.

FIG. 1 illustrates a front view of an exercising apparatus 100, in accordance with a first embodiment of the present invention. Exercising apparatus 100 is designed to fit around a seat such as a toilet seat. The toilet seat serves as a seat for exercising apparatus 100. Exercising apparatus 100 includes a frame 102, one or more first resistance devices, such as a first resistance device 104*a* and a first resistance device 104*b*, one or more arms, such as an arm 106*a* and an arm 106*b*, one or more flanged sleeves such as a flanged sleeve 108*a* and a flanged sleeve 108*b*, one or more second resistance devices, such as a second resistance device 110*a* and a second resistance device 110*b* and one or more gripping handles, such as a gripping handle 112*a* and a gripping handle 112*b*.

Figure 29A:
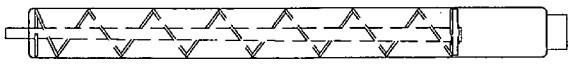
FIGS. 29*a* and 29*b* illustrate resistance and retracting devices for pivotal and extension movements, respectively, of an arm in the exercise apparatus according to the present invention.
Figure 29B:
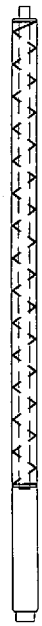

Examples of first resistance devices 104*a* and 104*b* and second resistance devices ll0*a* and 110*b* are shown in FIGS. 29*a* and 29*b* , respectively. Each resistance device comprises a standard damping device formed by a piston moveable within a cylinder. The piston is biased in a preferred direction by means of a coil spring which serves as a retracting device.

First resistance device 104*a* and first resistance device 104*b* are hereinafter referred to as first resistance devices 104. Arm 106*a* and arm 106*b* are hereinafter referred to as arms 106. Flanged sleeve 108*a* and flanged sleeve 108*b* are hereinafter referred to as flanged sleeves 108. Second resistance device 110*a* and second resistance device 110*b* are hereinafter referred to as second resistance devices 110. Gripping handle 112*a* and a gripping handle 112*b* are hereinafter referred to as gripping handles 112.

According to various embodiments of the present invention, frame 102 has a U-shaped configuration and a lateral open area to fit around a seat.

In an embodiment of the present invention, frame 102 includes a pair of laterally spaced parallel side frame members that are interconnected at ends through a transversely extending end frame member. The side frame members and the end frame member are adapted to be attached to a support. The side frame members and the end frame member are explained in detail in conjunction with FIG. 17 and FIG. 18.

In an embodiment as shown in FIG. 1, the open ends of frame 102 are secured to the support through one or more attachment devices, such as an attachment device 114*a* and an attachment device 114*b*. Attachment device 114*a* and attachment device 114*b* are hereinafter referred to as attachment devices 114. Attachment devices 114 are explained in detail in conjunction with FIG. 5.

Frame 102 is made of a plurality of tubular frame members of adequate strength and size, which are of conventional metal construction. The frame members may be secured together by welding or detachable joints.

Frame 102 is standing on the floor through one or more levelers, such as a leveler 116*a* and a leveler 116*b*. Leveler 116*a* and leveler 116*b* are hereinafter referred to as levelers 116. Levelers 116 are removably attached to frame 102 for positioning frame 102 in a generally horizontal plane with respect to the base. In addition, levelers 116 provide stability to frame 102. For example, levelers 116 such as rubber mats may be used to provide stability to frame 102.

Frame 102 may be standing on a floor and/or secured to a wall. In another embodiment of the present invention, frame 102 may be secured to the seat, explained in detail in conjunction with a second and a third embodiment of the present invention.

Arms 106 are coupled to frame 102 at one or more pivots, such as a pivot 118*a* and a pivot 118*b*. Pivot 118*a* and pivot

118*b* are hereinafter referred to as pivots 118. In an embodiment as shown in FIG. 1, arm 106*a* and arm 106*b* are pivoted to frame 102 about pivot 118*a* and pivot 118*b*, respectively. Pivots 118 allow a pivotal motion of arms 106 about pivots 118. Pivots 118 are explained in detail in conjunction with FIG. 7. In an embodiment as shown in FIG. 1, arms 106 are in the shape of a hollow cylindrical structure. Arms 106 are explained in detail in conjunction with FIG. 19 and FIG. 20.

First resistance devices 104 provide resistance to the pivotal motion of arms 106. First resistance devices 104 are coupled to frame 102 and arms 106. In an embodiment as shown in FIG. 1, first resistance device 104*a* and first resistance device 104*b* exert a counter force to pivotal motion of arm 106*a* and arm 106*b*, respectively. Examples of first resistance devices 104 include, but are not limited to, pneumatic cylinders, hydraulic cylinders, motorized resistance devices and the like.

In an embodiment of the present invention, exercising apparatus 100 includes one or more first retracting devices (not shown in FIG. 1) to provide retraction to the pivotal motion of each of arms 106. The first retracting devices may be adjusted to control the speed of retraction of each of arms 106 as desired by the user. Examples of the first retracting devices include, but are not limited to, springs, elastic rods, rubber belts and the like. In another embodiment of the present invention, first resistance devices 104 may include one or more first retracting devices for retracting arms 106. For example, first resistance device 104*a* may be a hydraulic cylinder with a spring. The hydraulic cylinder provides resistance and the spring provides retraction to the pivotal motion of arm 106*a*. Further, the first resistance devices and the first retracting devices may be adjusted to control the amount of resistance or the speed of retraction, based on the preference of a user.

Further, one or more covers, such as a cover 120*a* and a cover 120*b*, are mounted on first resistance device 104*a* and first resistance device 104*b*, respectively. Cover 120*a* and cover 120*b* are hereinafter referred to as covers 120. Covers 120 provide an outer cover to first resistance devices 104. Covers 120 are explained in detail in conjunction with FIG. 4.

Gripping handles 112 are attached to arms 106. According to various embodiments of the present invention, gripping handles 112 are coupled to shafts (not shown in FIG. 1) through flanged sleeves 108. The shafts are protruding axially from arms 106. In an embodiment as shown in FIG. 1, gripping handles 112 are releasably attached to the shafts. Gripping handles 112 may be extended and retracted by the linear axial movement of the shafts with respect to arms 106. Further, a bearing arrangement (not shown in FIG. 1) is provided on arms 106 for reducing the friction during the linear axial movement of the shafts. For example, the bearing arrangement is a nylon thrust bearing that slides on arms 106 during the linear axial movement of the shafts.

In an embodiment as shown in FIG. 1, the dotted lines such as a dotted line 122*a* and a dotted line 122*b* depict the linear axial movement of shafts with respect to arms 106. The dotted line 122*a* and the dotted line 122*b* are herein after referred to as dotted lines 122. The dotted lines 122 depict the linear axial movement of the shafts with respect to arms 106.

According to various embodiments of the present invention, the shafts are inserted into arms 106. The shafts are moveable with respect to arms 106 along vertical axis of arms 106. The vertical axis passes from the center of arms 106 along gripping handles 112 and pivots 118. The shafts are explained in detail in conjunction with FIG. 7.

Second resistance devices 110 provide resistance to the linear axial movement of the shafts. Examples of second resistance devices 110 include, but are not limited to, pneumatic cylinders, hydraulic cylinders, motorized resistance devices and the like. Second resistance devices 110 are explained in detail in conjunction with FIG. 7.

In an embodiment of the present invention, exercising apparatus 100 includes a second retracting device (not shown in FIG. 1) to provide retraction to the linear axial movement of each of the shafts. The second retracting devices may be adjusted to control the speed of retraction of the shafts along the vertical axis of arms 106, based on the preference of a user. Examples of the second retracting device include, but are not limited to, springs, elastic rods, rubber belts and the like. In another embodiment, second resistance devices 110 include one or more second retracting devices for retracting the shafts along the vertical axis of arms 106.

Depending upon the exercise performed by the user, resistance providing device, retraction providing device or a combination thereof may be used at different instances.

In accordance with an embodiment of the present invention, frame 102 and arms 106 are made of metal tubes. It should further be understood that the term "tubes" here defines an elongated, substantially hollow body. Although a cylindrically shaped tube is preferable, other shaped tubes may also be employed.

The dimensions, materials, and other aspects of the present invention may be varied substantially. For example, frame 102, arms 106, the shafts and gripping handles 112 may be made of any desired material of adequate strength such as metal tubing of round cross-section, or wooden dowels.

Figure 2:
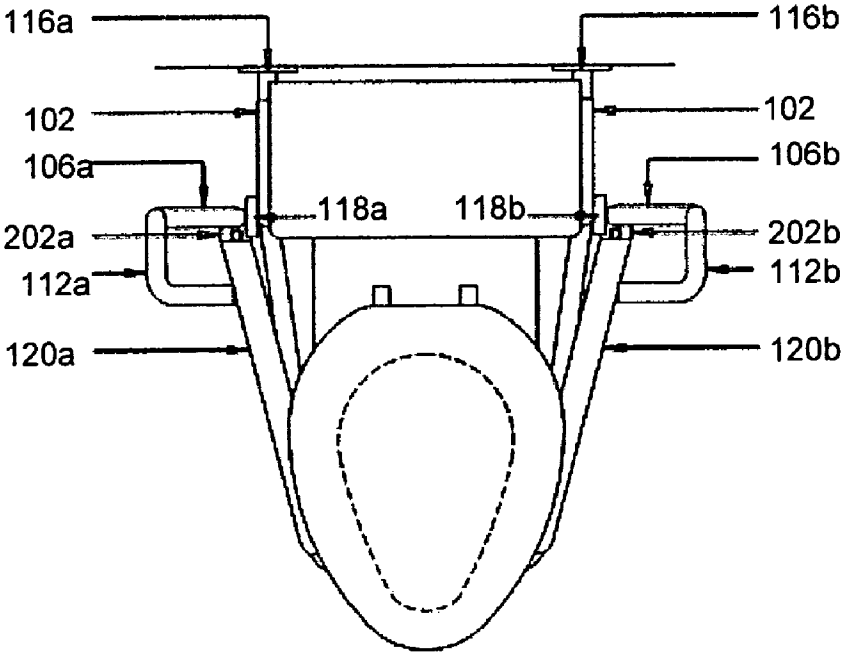
FIG. 2 illustrates a top view of the exercising apparatus of FIG. 1, in accordance with the first embodiment of the present invention.

FIG. 2 illustrates a top view of exercising apparatus 100 of FIG. 1, in accordance with the first embodiment of the present invention. Frame 102 is designed to fit around a toilet seat and is secured to a wall through attachment devices 114. In an embodiment as shown in FIG. 2, gripping handle 112*a* and gripping handle 112*b* have an L-shaped structure to enable a user to exert a directional force on arms 106. Further, griping handles 112 may be extended and retracted along the vertical axis at any time during the pivotal motion of arms 106.

In another embodiment, gripping handle 112*a* and gripping handle 112*b* may be connected with each other using a rod. A user may apply the directional force on the rod to provide a pivotal motion to arms 106. Moreover, the rod can be extended or retracted by the user.

First resistance devices 104 are coupled to arms 106 through one or more clevises, such as a clevis 202*a* and a clevis 202*b*. Clevis 202*a* and clevis 202*b* are hereinafter referred to as devises 202. Clevises 202 are explained in detail in conjunction with FIG. 3 and FIG. 6 of the present invention.

It should be understood that the coupling arrangements shown are for illustrative purposes only, and that other coupling arrangements may be suitable for carrying out the invention.

Figure 3:
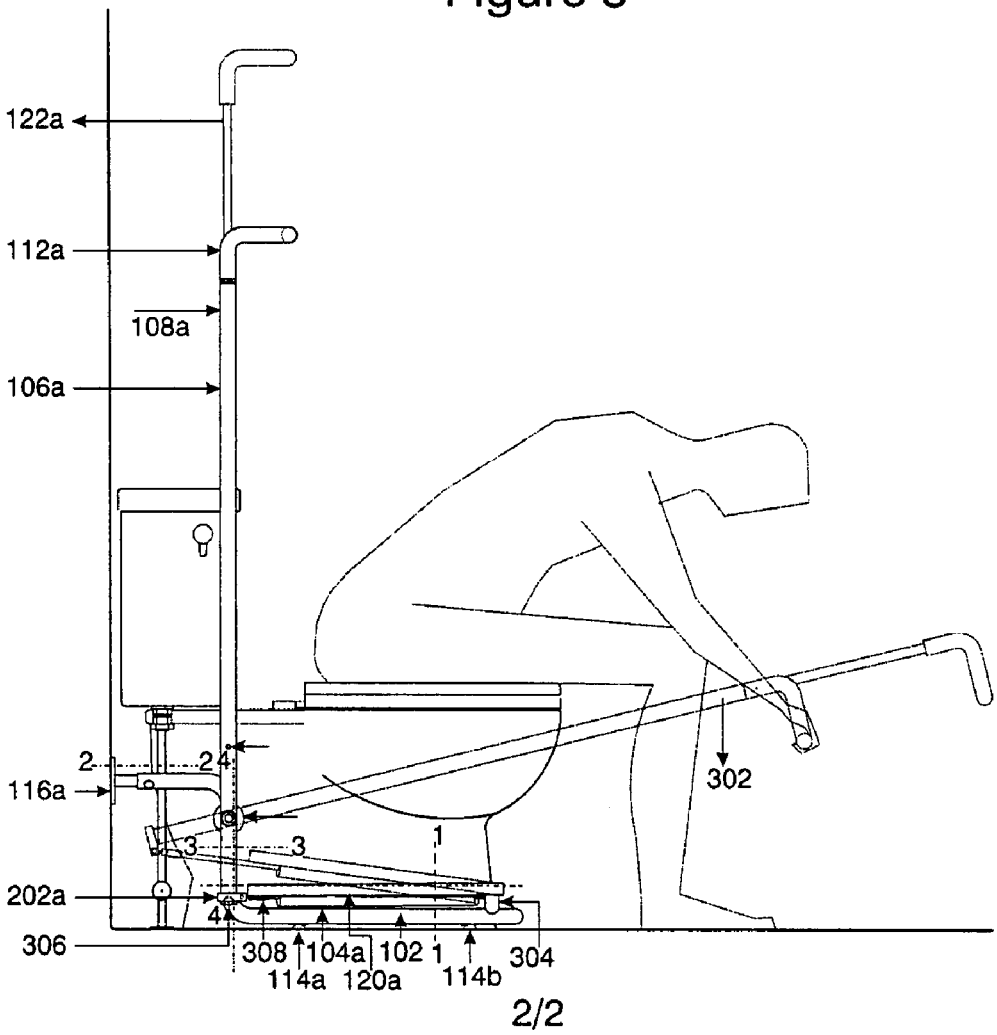
FIG. 3 illustrates a side view of the exercising apparatus of FIG. 1, in accordance with the first embodiment of the present invention.

FIG. 3 illustrates a side view of exercising apparatus 100 in accordance with the first embodiment of the present invention. As shown in FIG. 3, arm 106*a* is coupled to frame 102 at pivot 118*a*. A user exerts a directional force on arm 106*a* while sitting on a toilet seat. In another embodiment of the present invention, the user may exert directional force on arms 106 while standing. In an embodiment as shown in FIG. 3, a first position of arm 106*a* is illustrated in solid lines of arm 106*a* and a second position of arm 106*a* is illustrated in a dotted line 302. The first retracting devices retract arm 106*a* from the second position to the first position. First resistance device 104*a* is secured to frame 102 by a first binding screw 304. First binding screw 304 is explained in detail in conjunction with FIG. 4.

Clevis 202*a* couples first resistance device 104*a* to arm 106*a*. First resistance device 104*a* applies resistance to the pivotal motion of arm 106*a*. First resistance device 104*a* may vary the resistance by adjusting position of clevis 202*a* on arm 106*a*. In an embodiment as shown in FIG. 3, arm 106*a* includes a bottom arm portion, which extends from pivot 118*a* to the end of arm 106 that is coupled to first resistance device 104*a*. The bottom arm portion includes one or more holes predisposed therein. Clevis 202*a* couples first resistance device 104*a* to the bottom arm portion of arm 106*a* at the holes. Release pin 306 is inserted through the holes and clevis 202*a* to position clevis 202*a* on arm 106*a*. Moreover, position of clevis 202*a* is adjustable on the holes to vary the resistance provided by first resistance device 104*a*. Further, clevis 202*a* is attached to first resistance device 104*a* through a joint 308. Joint 308 is explained in detail in conjunction with FIG. 6.

Figure 4:
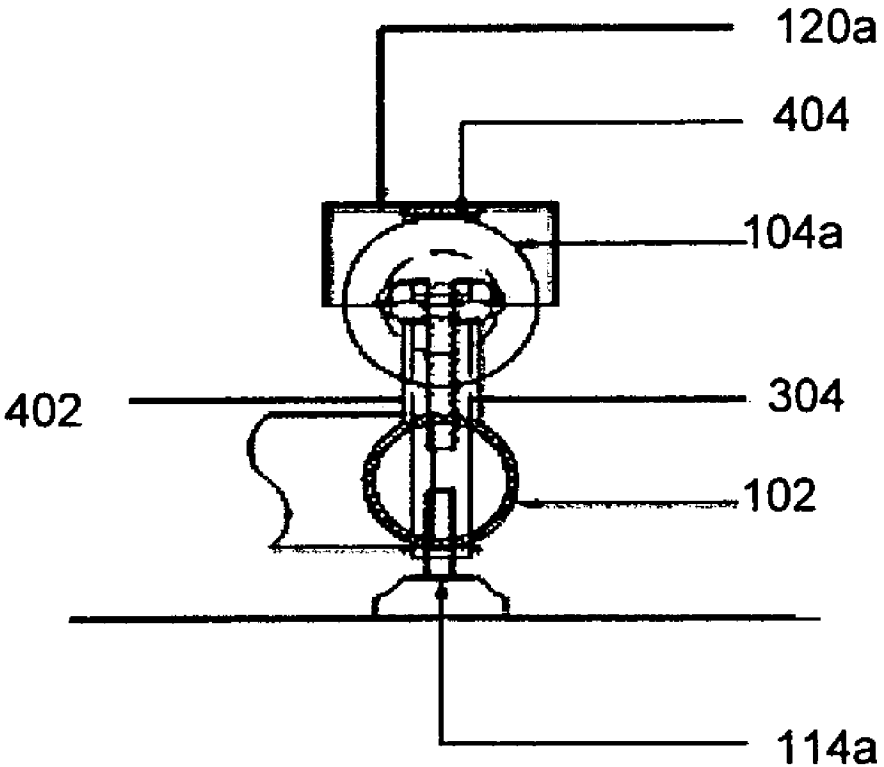
FIG. 4 illustrates a sectional view taken along the section lines 1-1 in FIG. 3 of the exercising apparatus of FIG. 1, in accordance with the first embodiment of the present invention.
Figure 5:
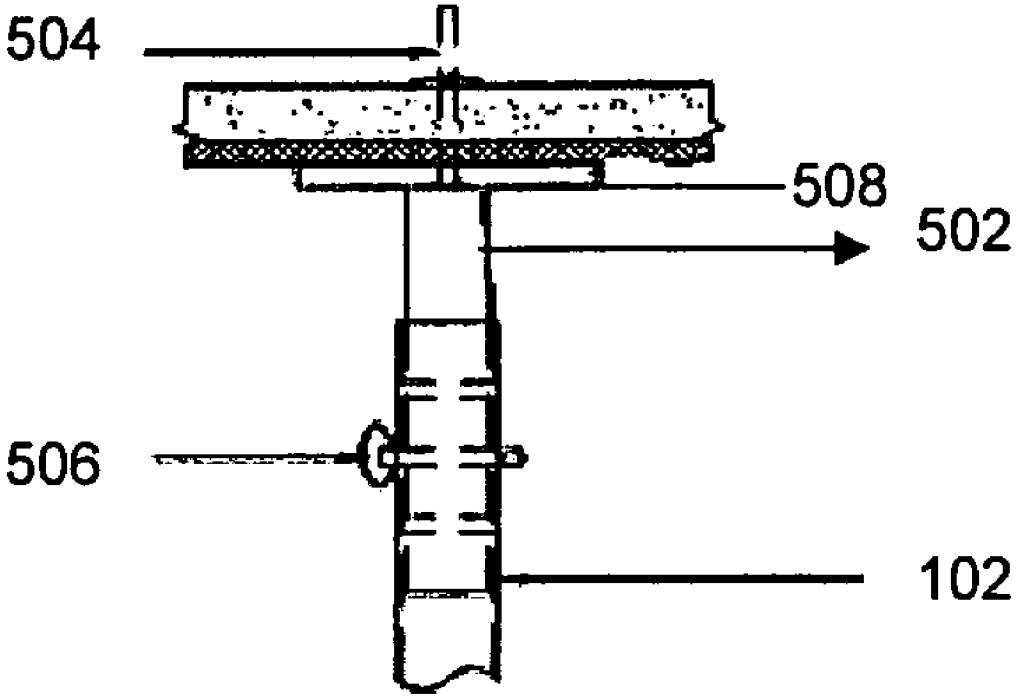
FIG. 5 illustrates a sectional view taken along the section lines 2-2 in FIG. 3 of the exercising apparatus of FIG. 1, in accordance with the first embodiment of the present invention.
Figure 6:
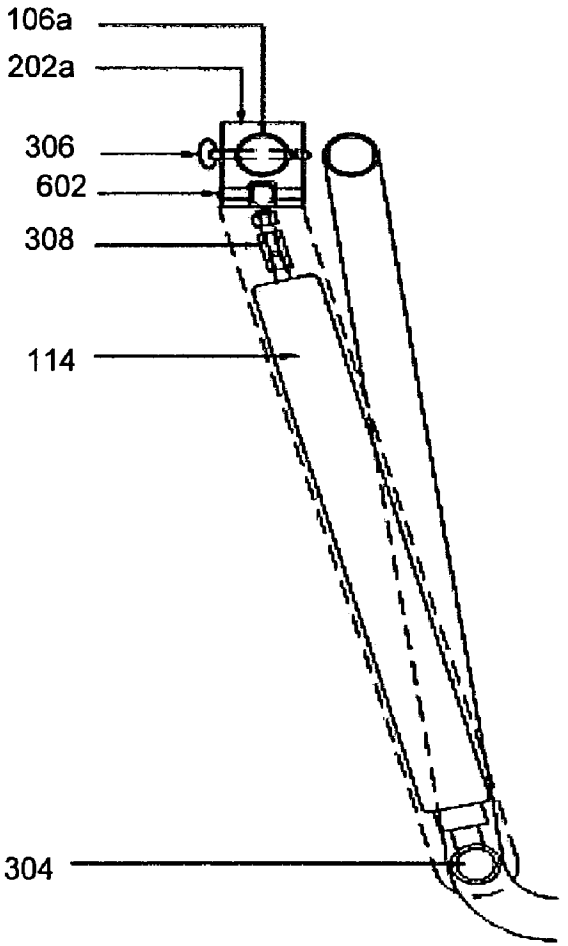
FIG. 6 illustrates a sectional view taken along the section lines 3-3 in FIG. 3 of the exercising apparatus of FIG. 1, in accordance with the first embodiment of the present invention.

Exercising apparatus 100 is divided along section lines 1-1, section lines 2-2, section lines 3-3 and section lines 4-4 and their corresponding sectional views have been illustrated in FIG. 4, FIG. 5 and FIG. 6, respectively.

It is to be understood that the specific movement of arm 106*a* is for the convenience of the reader and is not to be construed as limiting exercising apparatus 100 to a specific arrangement. In an embodiment as shown in FIG. 1, arrangement for pivotal motion of arm 106*a* is described. However, it is to be understood that exercising apparatus 100 will include a corresponding arrangement for pivotal motion of arm 106*b*. In another embodiment of the present invention, a user may exert a directional force on only arm 106*a*.

Those skilled in the art will recognize that the various embodiments of exercising apparatus 100 described above may be used to perform numerous beneficial exercises. It is to be understood that the specific exercising positions shown in FIG. 3 is for the convenience of the reader and these are non-limiting illustrations only.

FIG. 4 illustrates a sectional view taken along the section lines 1-1 in FIG. 3 of exercising apparatus 100, in accordance with the first embodiment of the present invention. First resistance device 104*a* is secured to frame 102 by first binding screw 304. A barrel cover 402 is provided to cover first binding screw 304 for reducing the wear and tear of first binding screw 304. Further, cover 120*a* provides an outer cover to first resistance device 104*a*. Cover 120*a* is attached to first resistance device 104*a* through a hook 404. Cover 120 reduces the wear and tear of first resistance device 104*a*.

FIG. 5 illustrates a sectional view taken along the section lines 2-2 in FIG. 3 of exercising apparatus 100, in accordance with an embodiment of the present invention. Attachment device 114*a* includes a rod 502, a bolt 504 and a release pin 506. According to various embodiments of the invention, rod 502 is sized to fit into the open ends of frame 102. As shown in FIG. 5, rod 502 is cylindrically shaped metal rod that is coupled to frame 102 and a wall.

In an embodiment as shown in FIG. 5, one end of rod 502 is inserted in frame 102 and other end is attached to the wall through a disc 508. Disc 508 includes screw holes predisposed therein for attaching rod 502 to the wall through bolt 504. In an embodiment of the present invention, rod 502 includes holes that may be aligned with the holes in frame 102 and release pin 506 is inserted between the aligned holes. Frame 102 is held in place through release pin 506.

FIG. 6 illustrates a sectional view taken along the section lines 3-3 in FIG. 3 of exercising apparatus 100, in accordance with the first embodiment of the present invention. In an embodiment as shown in FIG. 6, a piston rod of first resistance device 104*a* is attached at clevis 202*a*. The piston rod is attached to clevis 202*a* through joint 308 such as an in-ball joint linkage by a second binding screw 602. Further, devises 202 are attached to arms 106 through release pin 306.

Figure 7:
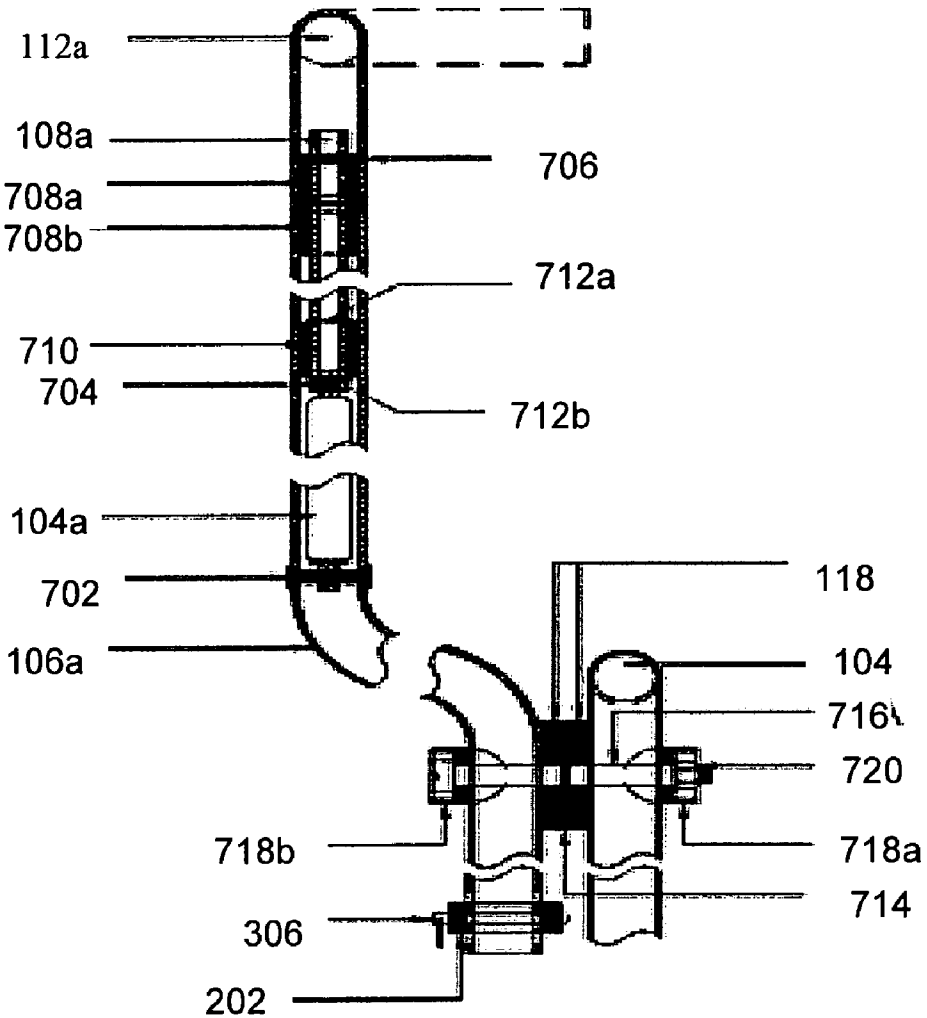
FIG. 7 illustrates a sectional view taken along the section lines 4-4 in FIG. 3 of the exercising apparatus of FIG. 1, in accordance with the first embodiment of the present invention.

FIG. 7 illustrates a sectional view taken along the section lines 4-4 in FIG. 3 of exercising apparatus 100, in accordance with the first embodiment of the present invention. Second resistance device 110*a* applies resistance to the linear axial movement of a shaft 701. Second resistance device 110*a* is attached to arm 106*a* by a binding screw 702. In an embodiment as shown in FIG. 7, the piston rod of second resistance device 110*a* is recessed into shaft 701. The piston rod is locked with shaft 701 by a first spring pin 704. Further, shaft 701 is recessed into gripping handle 112*a* and is locked with gripping handle 112*a* by a second spring pin 706. Flanged sleeve 108*a* is placed at the end of arm 106*a* that is near to gripping handle 112*a*. Flanged sleeve 108*a* maintains the alignment of shaft 701 in arm 106*a*, during the linear axial movement of shaft 701. Further, a flanged sleeve 708 is placed inside gripping handle 112*a* at the end near to arm 106*a*. Flanged sleeve 708 maintains the alignment of shaft 701 in gripping handle 112*a*, during the linear axial movement of shaft 701.

Further, a bearing arrangement 710 is placed between arm 106*a* and shaft 701. Bearing arrangement 710 reduces the friction between arm 106*a* and shaft 701 during the linear axial movement. Moreover, bearing arrangement 710 maintains the alignment of shaft 701 during the linear axial movement. Bearing arrangement 710 is restrained from axially moving out of arm 106*a* by one or more retaining rings, such as a retaining ring 712*a* and a retaining ring 712*b*. Retaining ring 712*a* and retaining ring 712*b* are hereinafter referred to as retaining rings 712. In an embodiment as shown in FIG. 7, retaining rings 712 are placed at the ends of bearing arrangement 710.

In an embodiment, pivot 118*a* is welded on frame 102 and arm 106*a*. A plastic washer 714 is placed inside pivot 118*a*. In an embodiment as shown in FIG. 7, plastic washer 714 aligns pivot 118*a* with respect to frame 102 and arm 106*a*. A shoulder screw 716 passes through a clamp washer 718*a* and a clamp washer 718*b*, pivots 118 and plastic washer 714 to attach arm 106*a* to frame 102 about pivot 118*a*. Clamp washer 718*a* and clamp washer 718*b* are hereinafter referred to as clamp washers 718. Clamp washers 718 are locked in place with a locknut 720.

FIG. 8 to FIG. 16 illustrates an exercising apparatus, in accordance with a second embodiment the present invention. Various elements shown in FIG. 8 to FIG. 16, to the extent that they are similar to corresponding elements in the first embodiment of exercising apparatus 100 of FIG. 1 to FIG. 7, are designated with the same reference numerals.

Figure 8:
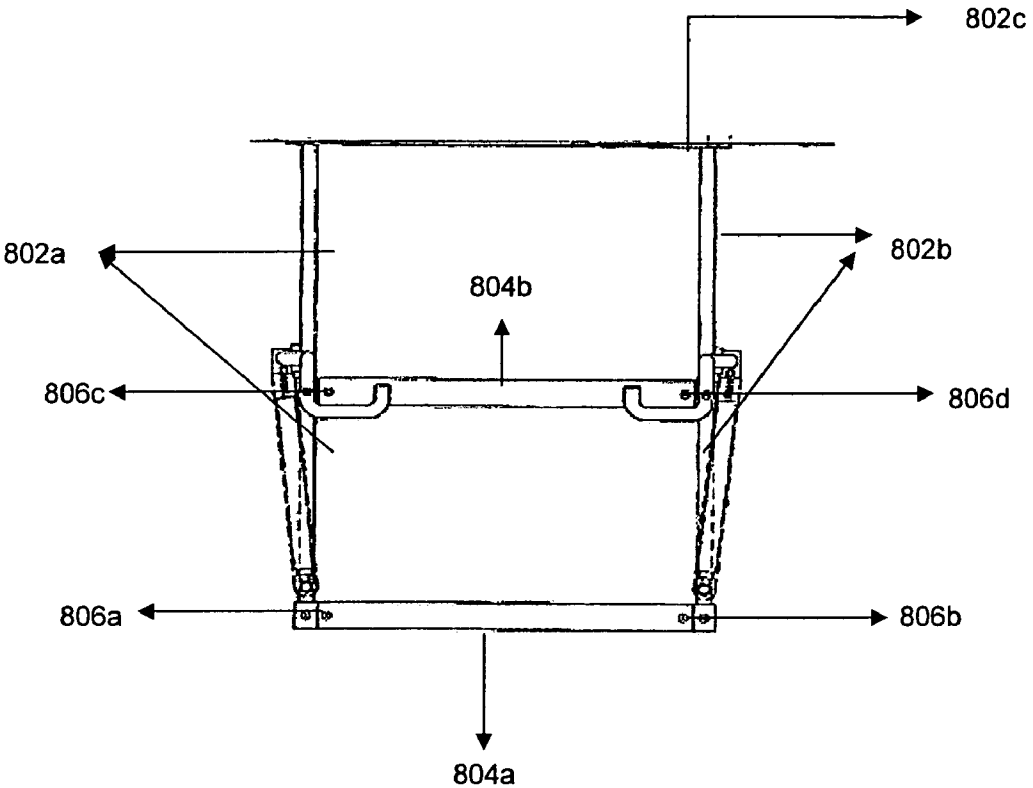
FIG. 8 is a plan view of an exercising apparatus, in accordance with a second embodiment of the present invention.
Figure 9:
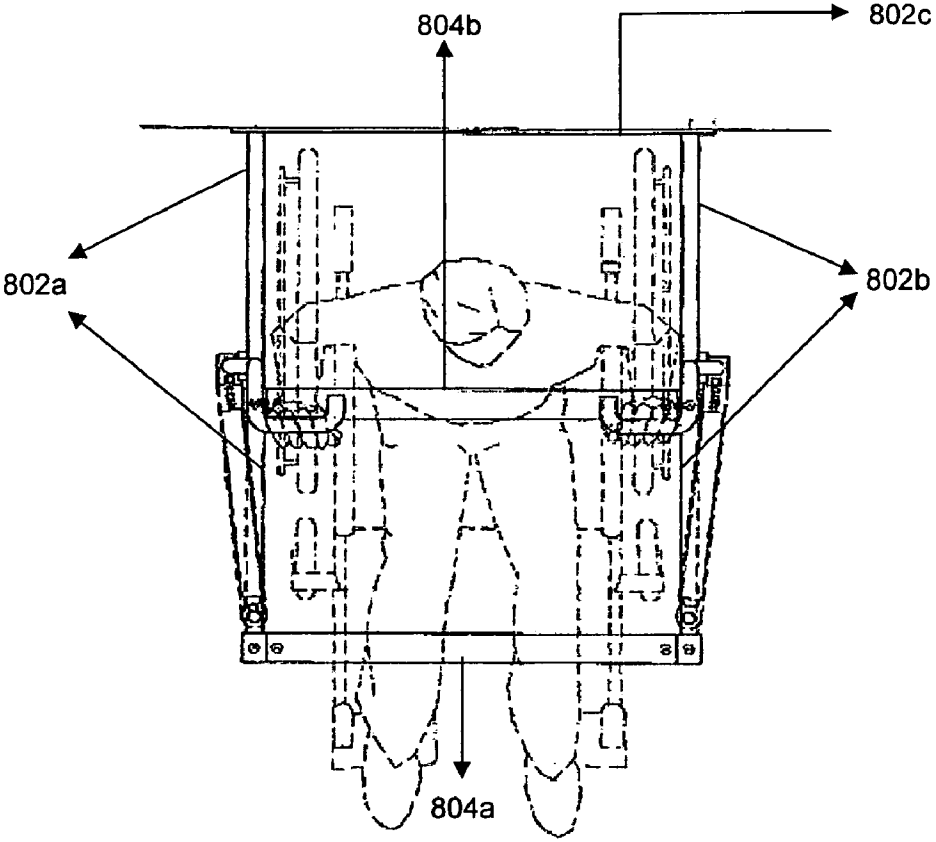
FIG. 9 illustrates a top view of the exercising apparatus of FIG. 8, in accordance with the second embodiment of the present invention.

FIG. 8 is a plan view of an exercising apparatus 800 in accordance with second embodiment of the present invention. Exercising apparatus 800 includes a frame that is designed to receive a seat. The frame is mounted on a base and is secured to a support. In an embodiment of the present invention, the frame has a U-shaped configuration with a lateral open area to receive a wheelchair into the frame to a position as illustrated in FIG. 9, of the present invention.

Further, the frame includes a pair of laterally spaced, parallel side frame members, such as a side frame member 802*a* and a side frame member 802*b*. An end frame member 802*c* is placed adjacent to one end of side frame member 802*a* and transversely extends and connects side frame member 802*a* and side frame member 802*b*. One or more holes are predisposed therein on end frame member 802*c*.

In an embodiment of the present invention, end frame member 802*c* may be attached to side frame member 802*a* and side frame member 802*b* by welding. It should be understood that end frame member 802*c* may be joined to side frame member 802*a* and side frame member 802*b* in any suitable manner. The open ends of side frame member 802*a* and side frame member 802*b* are not connected and provide an open space to receive the wheelchair.

A combination of side frame member 802*a*, side frame member 802*b* and end frame member 802*c* are hereinafter referred as frame 802. Frame 802 is secured to a support and designed to receive a seat. Examples of the seat include, but are not limited to, a wheelchair, a chair, a barstool, a bench, a table and the like.

In an embodiment of the present invention as shown is FIG. 8, frame 802 is secured to a wall through attachment devices. The attachment devices are passed through the holes in end frame member 802*c* and attach frame 802 to the support, such as wall. Examples of the attachment devices include, but are not limited to, nut and bolt arrangement, screws, fasteners and the like. In another embodiment of the present invention, frame 802 is secured to a the seat.

In an embodiment as shown in FIG. 8, one or more base plates, such as a base plate 804*a* and a base plate 804*b* are removably attached to side frame member 802*a* and 802*b* through a joint 806*a* and a joint 806*b*, and a joint 806*c* and a joint 806*d*, respectively. Base plate 804*a* and base plate 804*b* are hereinafter referred to as base plates 804. Further, base plates 804 have an elevated structure. Base plates 804 provide the resistance to motion of wheels of the wheelchair and prevents the wheelchair from moving out of frame 802 during exercising.

Further, exercising apparatus 800 includes arm 106*a*, arm 106*b*, first resistance device 104*a*, first resistance device 104*b*, gripping handle 112*a* gripping handle 112*b*, clevis 202*a*, clevis 202*b*, pivot 118*a* and pivot 118*b*.

It is to be understood that arm 106*a* and arm 106*b*, first resistance device 104*a* and first resistance device 104*b*, gripping handle 112*a* and gripping handle 112*b*, clevis 202*a* and clevis 202*b*, pivot 118*a* and pivot 118*b* have similar structure and function as described in FIG. 1 to FIG. 7, and like reference numerals have been used for like parts as appropriate.

FIG. 9 illustrates a top view of exercising apparatus 800 in accordance with the second embodiment of the present invention. A wheelchair is received in frame 802 in a rearward direction such that back of a user faces the wall. In another embodiment of the present invention, wheelchair is received in frame 802 in a forward direction, such that the user faces the wall.

Figure 10:
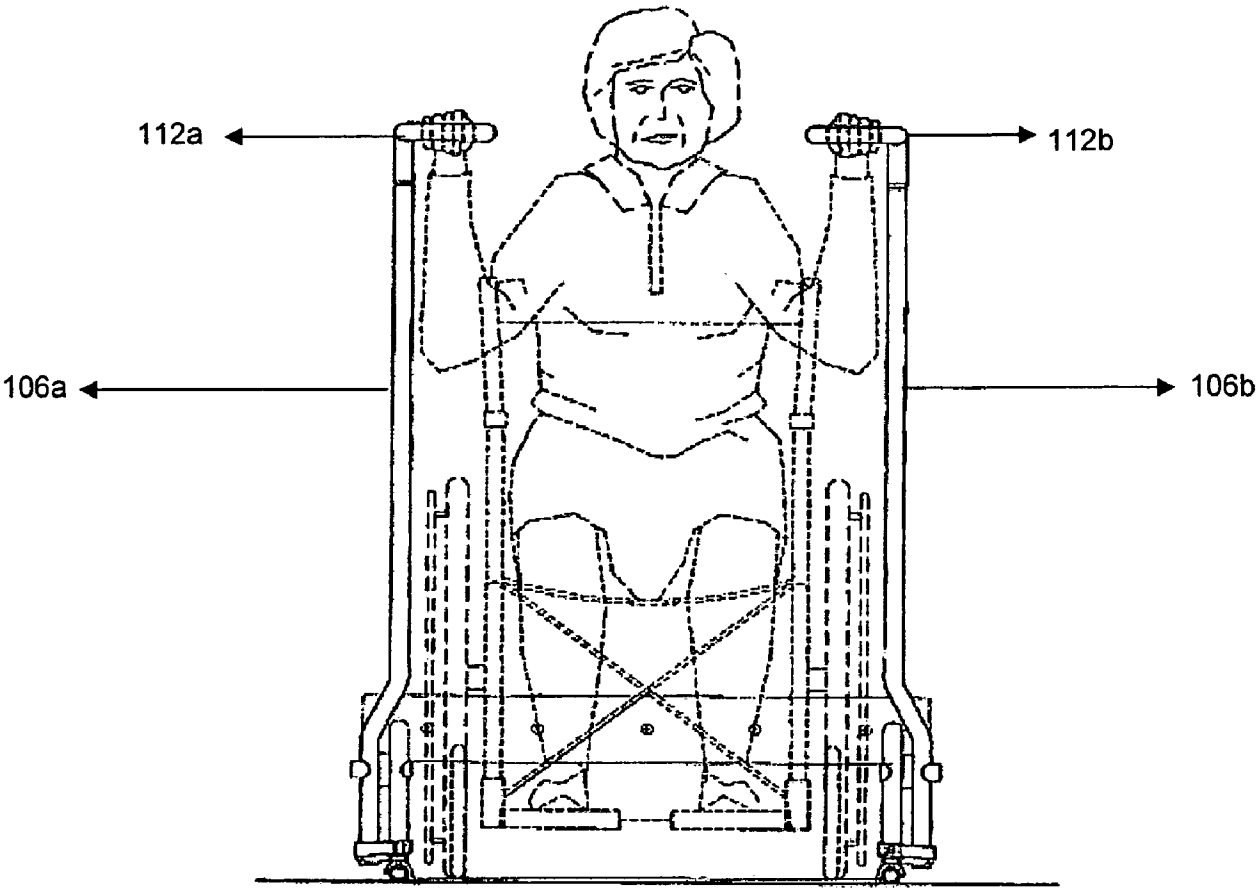
FIG. 10 illustrates a front view of the exercising apparatus of FIG. 8, in accordance with the second embodiment of the present invention.

FIG. 10 illustrates a front view of exercising apparatus 800 of FIG. 8. In an embodiment as shown in FIG. 10, a wheelchair rests over base plates 804.

Figure 11:
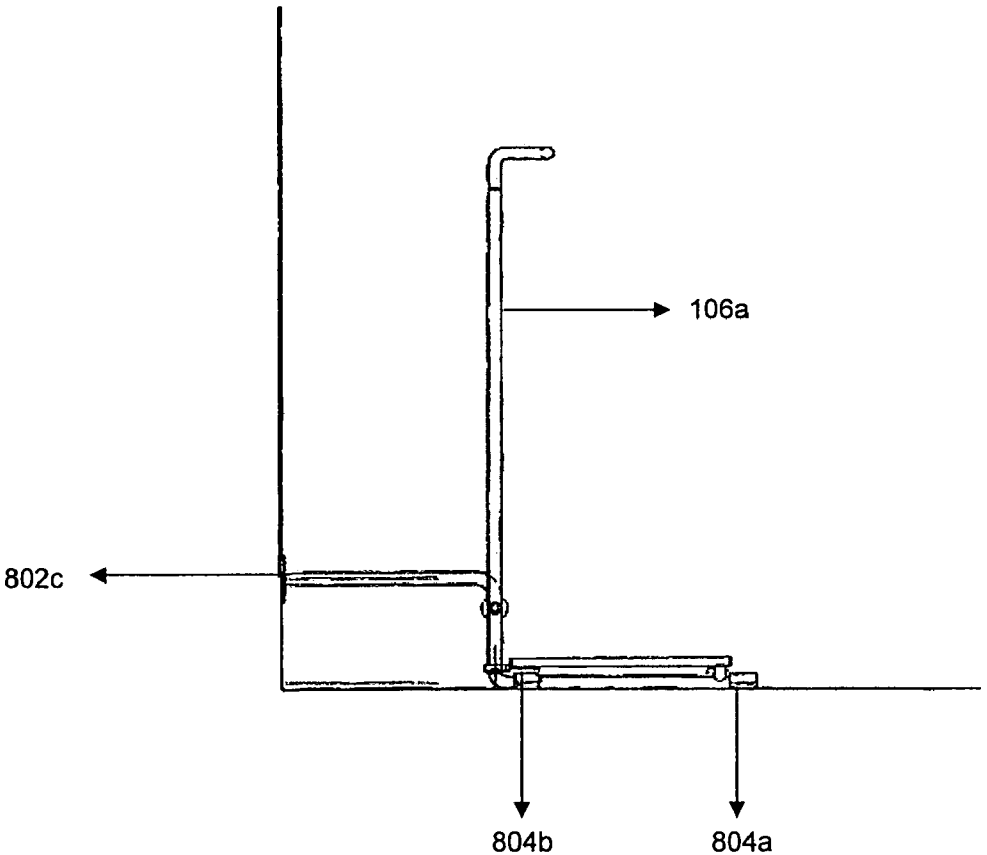
FIG. 11 illustrates a side view of the exercising apparatus of FIG. 8, in accordance with the second embodiment of the present invention.

FIG. 11 illustrates a side view of exercising apparatus 800 in accordance with the second embodiment of the present invention. In an embodiment as shown in FIG. 11, base plates 804 are in an elevated position with respect to the floor to prevent movement of the wheelchair out of frame 802. Any other type of wheelchair locking device, including the wheelchair's own parking brakes, can also serve for this purpose.

Figure 12:
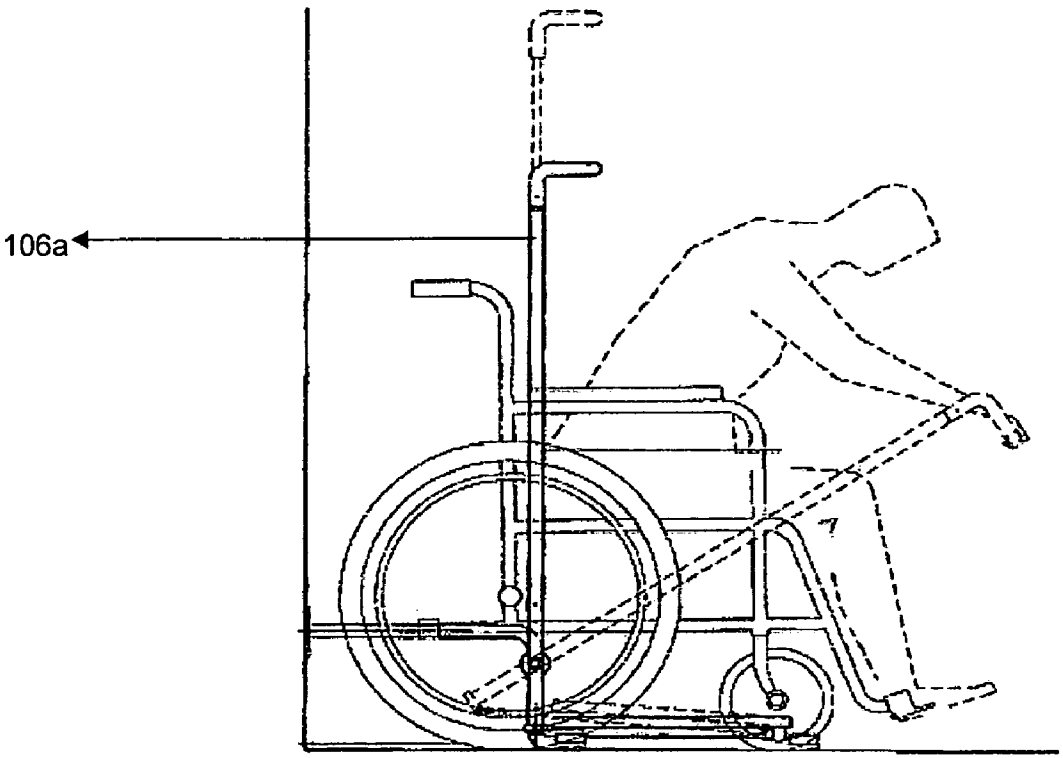
FIGS. 12, 13 and 14 illustrate side views of the exercising apparatus of FIG. 8, in accordance with the second embodiment of the present invention.
Figure 13:
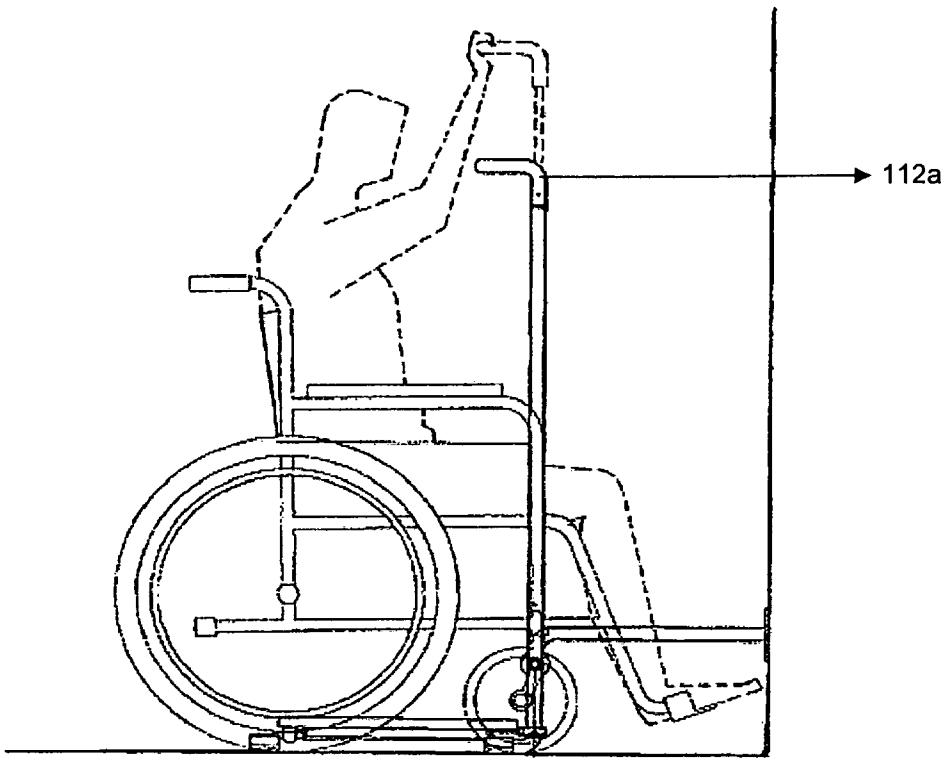
Figure 14:
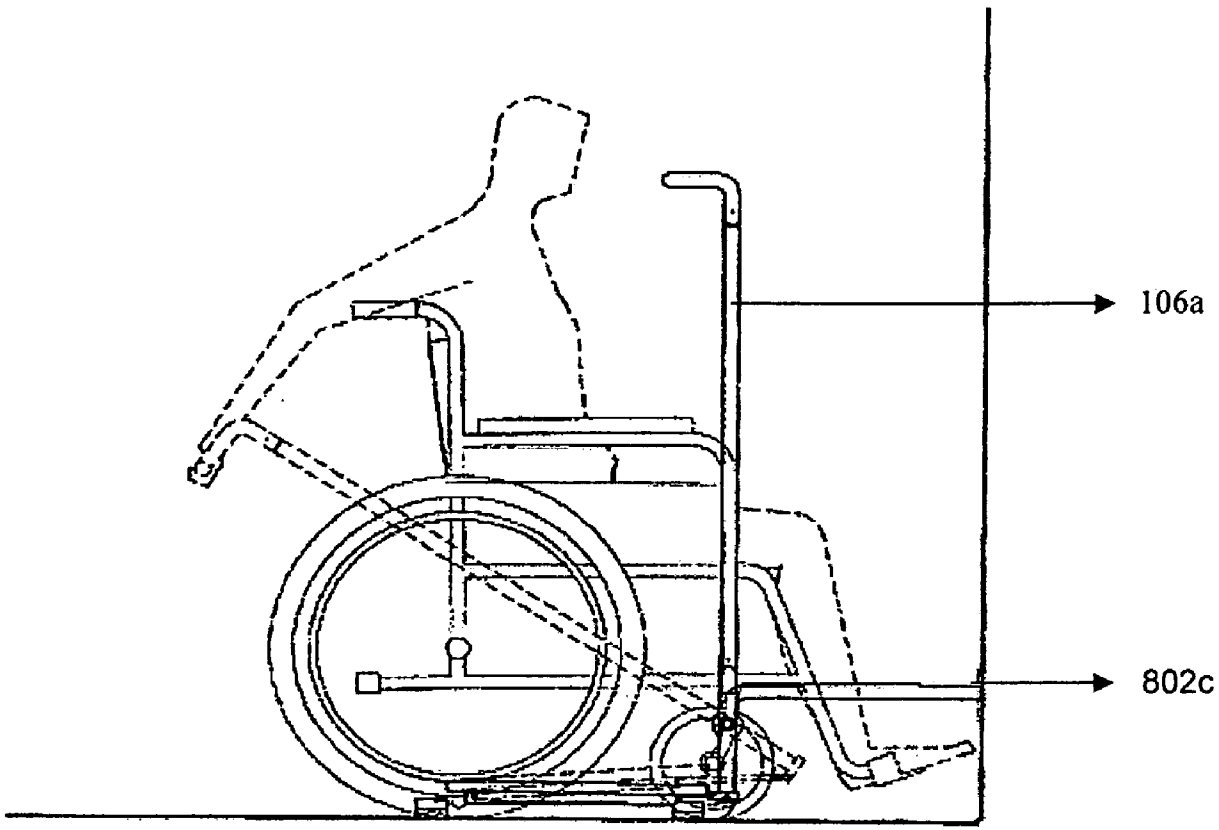

FIGS. 12, 13 and 14 illustrate side views of an exercising apparatus 800 in accordance with the second embodiment of the present invention. A user on the wheelchair exerts a directional force on gripping handle 112*a* to provide a pivotal motion to arm 106*a*. In an embodiment of the present invention, as shown in FIG. 12, solid lines of arm 106*a* depict first position of arm 106*a*, while dotted lines of arm 106*a* depict a second position of arm 106*a*.

In an embodiment of the present invention as shown in FIG. 13, the user exerts a directional force on gripping handle 112*a* to provide a linear axial movement to shaft 701. A first position of gripping handle 112*a* is depicted by solid lines of gripping handle 112*a*, while dotted lines of gripping handle 112*a* depicts a second position of gripping handle 112*a*.

In an embodiment of the present invention, as shown in FIG. 14, frame 802 receives a wheelchair in a reward direction such that the back of user faces end frame member 802*c*. The pivotal motion of arm 106*a* and the linear axial movement of shaft 701 are in a similar manner, as explained in FIG. 12 and FIG. 13, respectively.

FIG. 15 to FIG. 26 illustrates an exercising apparatus, in accordance with a third embodiment the present invention. Various elements shown in FIG. 15 to FIG. 26, to the extent that they are similar to corresponding elements in the first embodiment of exercising apparatus 100 of FIG. 1 to FIG. 7, are designated with the same reference numerals.

Figure 15:
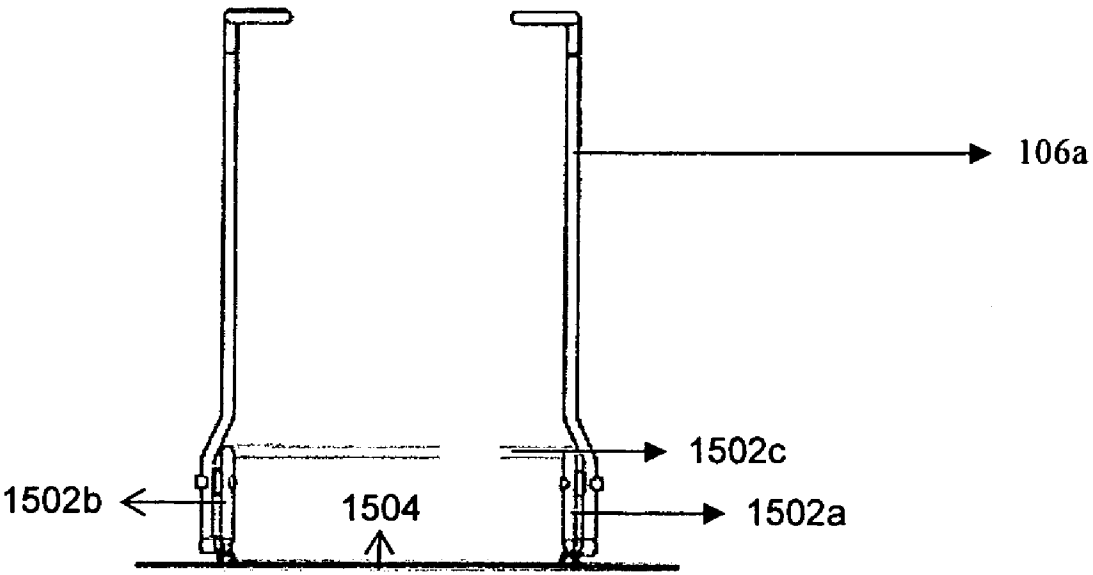
FIG. 15 illustrates a front view of an exercising apparatus, in accordance with a third embodiment of the present invention.

FIG. 15 illustrates a front view of an exercising apparatus 1500, in accordance with a third embodiment of the present invention. Exercising apparatus 1500 includes a frame, first resistance device 108*a*, first resistance device 108*b*, arm 106*a*, arm 106*b*, gripping handle 112*a* and gripping handle 112*b*.

Arms 106, first resistance device 104*a*, first resistance device 104*b*, second resistance device 110*a*, second resistance device 110*b*, gripping handle 112*a*, gripping handle 112*b*, have similar structure and function as described in FIG. 1 to FIG. 7, and like reference numerals have been used for like parts as appropriate.

A frame of exercising apparatus 1500 is mounted on a base and secured to the base. In an embodiment of the present invention, the frame has a U-shaped configuration with a lateral open area to receive a wheelchair into the frame to a position illustrated in FIG. 16. Further, the frame includes a pair of laterally spaced, parallel side frame members, such as a side frame member 1502*a* and a side frame member 1502*b*. An end frame member 1502*c* is adjacent to one end of the frame members and transversely extends and connects side frame member 1502*a* and side frame member 1502*b*. The open ends of side frame member 1502*a* and side frame member 1502*b* enable the wheelchair to be rolled into and out of the frame. In an embodiment of the present invention, end frame member 1502*c* may be attached to side frame member 1502*a* and side frame member 1502*b* by welding. It should be understood that the members may be joined together in any suitable manner. The open ends of side frame member 1502*a* and side frame member 1502*b* are not connected and thus leave an open space to receive the wheelchair to a position illustrated by dotted lines in FIG. 16. A combination of side frame member 1502*a*, side frame member 1502*b* and end frame member 1502*c* is hereinafter referred as frame 1502. In an embodiment as shown in FIG. 15, frame 1502 is secured to the wheelchair through a base member such as a base plate 1504.

Figure 16:
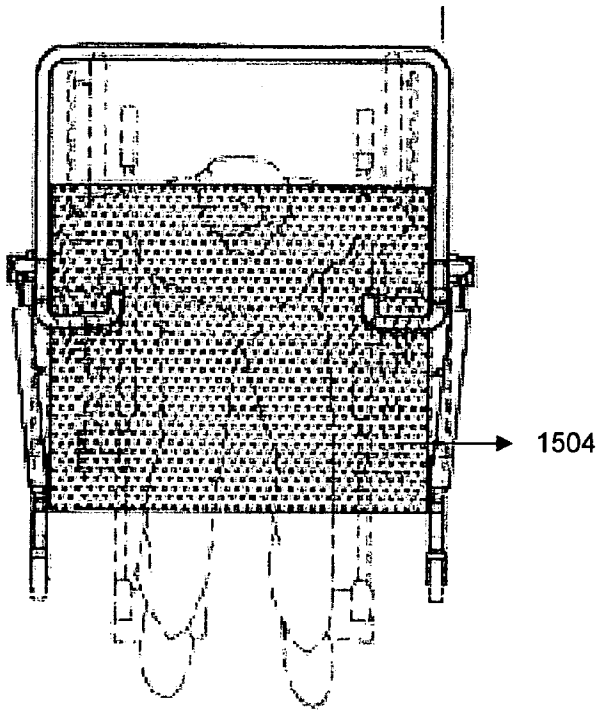
FIG. 16 illustrates a plan view of the exercising apparatus of FIG. 15, in accordance with the third embodiment of the present invention.

Base plate 1504 is removably coupled to side frame member 1502*a* and side frame member 1502*b* through a joint 1506*a* and a joint 1506*b*, respectively. Joint 1506*a* and joint 1506*b* are hereinafter referred to as joints 1506. In an embodiment as shown in FIG. 16, joints 1506 are engaged to frame 1502 through screws. Base plate 1504 is explained in detail in conjunction with FIG. 21 of the present invention.

FIG. 16 illustrates a plan view of exercising apparatus 1500 of FIG. 15 in accordance with the third embodiment of the present invention. Frame 1502 is designed to receive a wheelchair into and out of frame 1502. According to various embodiments of the present invention, base plate 1504 is adapted to receive the wheelchair. Base plate 1504 secures frame 1502 to the base by the weight of the user and the wheelchair.

It is to be understood that the specific dimensions for exercising apparatus 1500 and the wheelchair is for the convenience of the reader and is not to be construed as limiting exercising apparatus 1500 to specific sizes.

Figure 17:
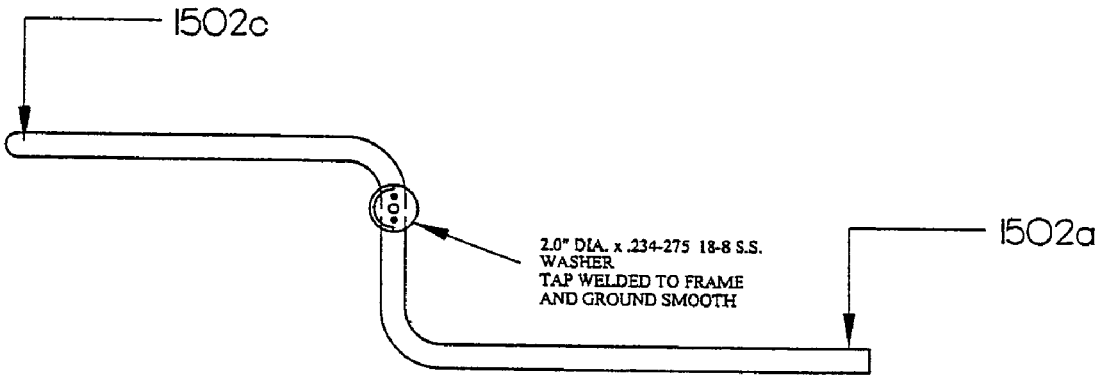
FIG. 17 illustrates a side view of a side frame member of the exercising apparatus of FIG. 15, in accordance with the third embodiment of the present invention.

FIG. 17 illustrates a side view of side frame member 1502*a* of FIG. 15, in accordance with the third embodiment of the present invention. In an embodiment of the present invention, as shown in FIG. 17, side frame member 1502*a* is generally Z-shaped and bended at 90 degrees angle at a bend 1702 and a bend 1704.

Figure 18:
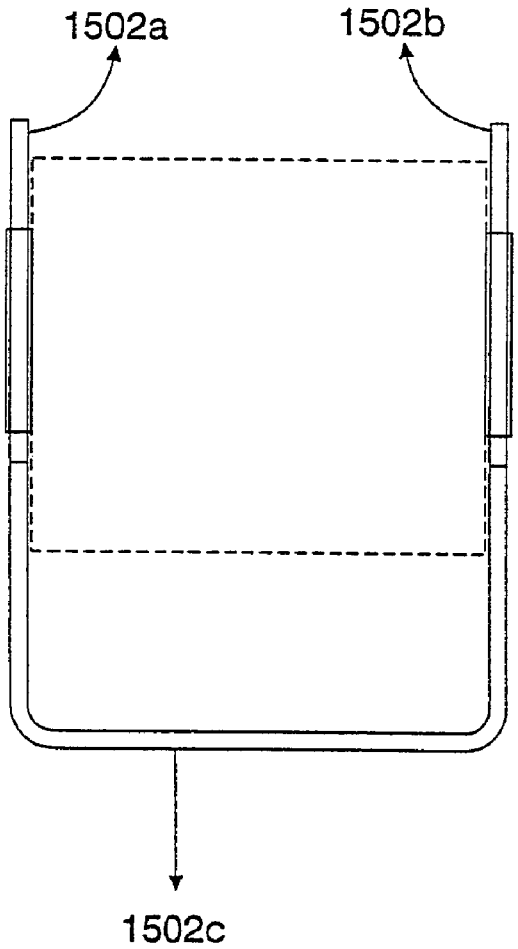
FIG. 18 illustrates a plan view of a frame of the exercising apparatus of FIG. 15, in accordance with the third embodiment of the present invention.

FIG. 18 illustrates a plan view of frame 1502 of FIG. 15, in accordance with the third embodiment of the present invention. As shown in FIG. 18, end frame member 1502*c* is attached to side frame member 1502*a* and side frame member 1502*b* at a bend 1802 and a bend 1804, respectively. End frame member 1502*c* is bended at an angle of 90 degrees at bend 1802 and 1804.

Figure 19:
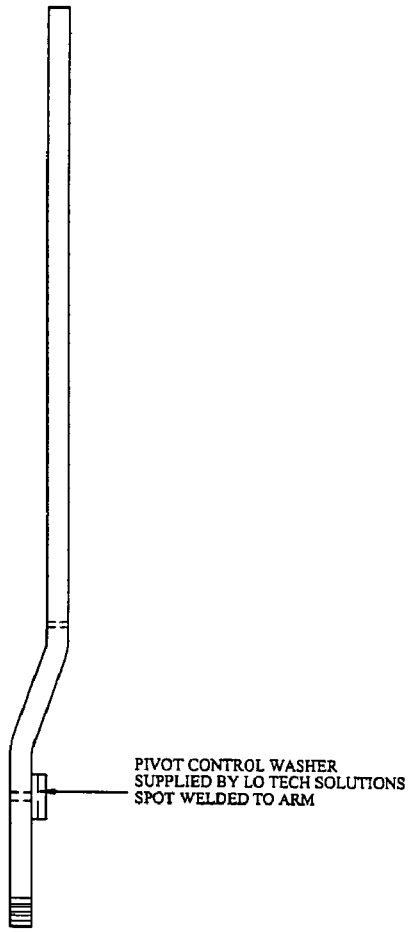
FIG. 19 illustrates a front view of an arm, in accordance with various embodiments of the present invention.

FIG. 19 illustrates a front view of arm 106*a*, in accordance with various embodiments of the present invention. As shown in FIG. 19, arm 106*a* is generally Z-shaped and bended at angles R1 and R2 at a bend 1902 and a bend 1904, respectively.

Figure 20:
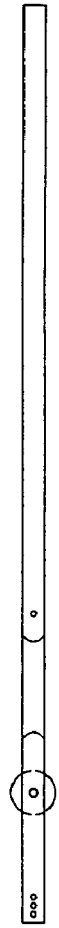
FIG. 20 illustrates a side view of the arm, in accordance with various embodiments of the present invention.

FIG. 20 illustrates a side view of arm 106*a* of FIG. 19, in accordance with various embodiments of the present invention. One or more holes at the end of arm 106*a* are placed for attachment of clevis 202*a*. Clevis 202*a* may be positioned on the holes through release pin 306.

Figure 21:
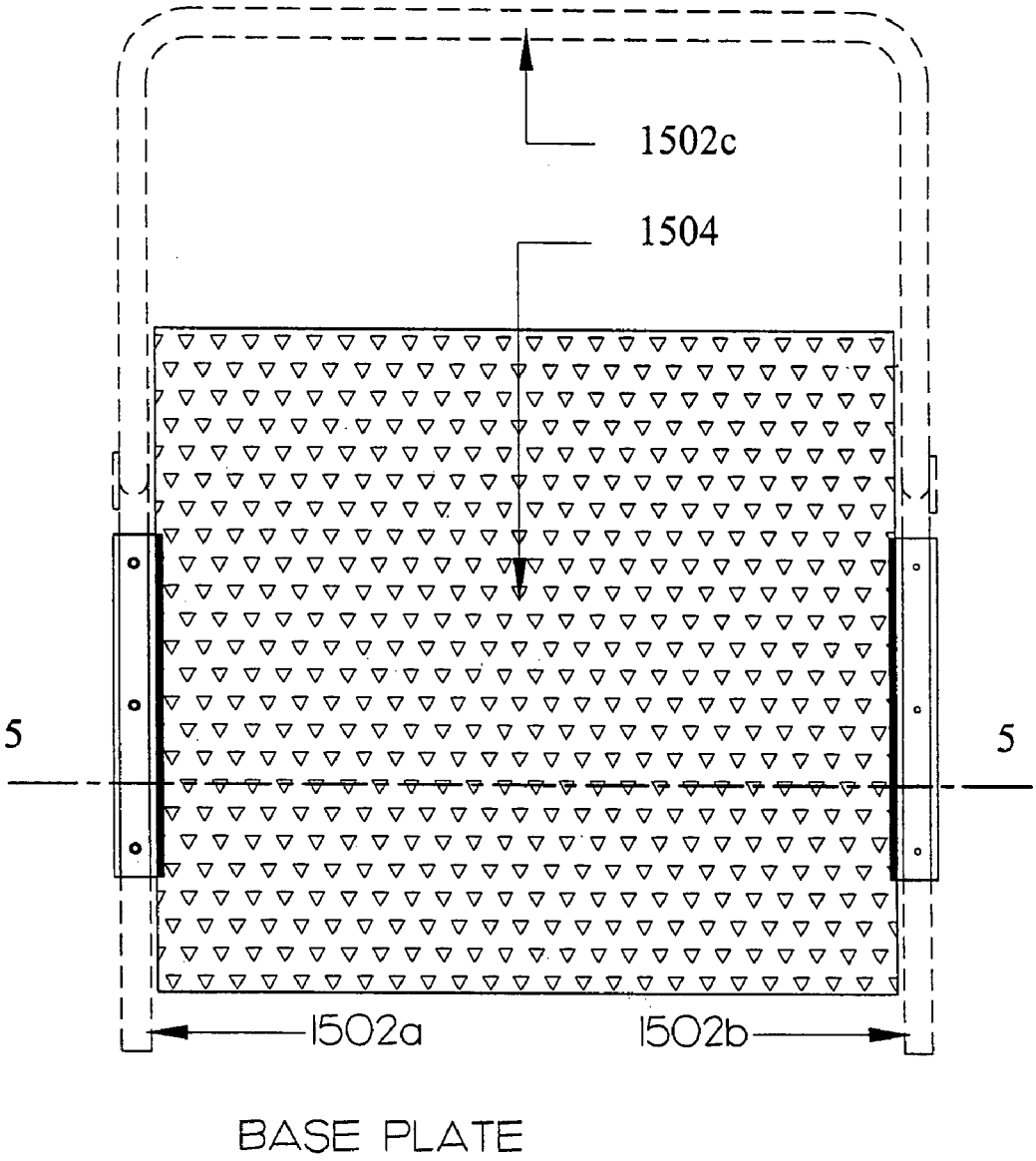
FIG. 21 illustrates a top view of a base plate, in accordance with the third embodiment of the present invention.

FIG. 21 illustrates a top view of base plate 1504, in accordance with the third embodiment of the present invention. As shown in FIG. 21, base plate 1504 is rectangular in shape and has treaded texture to provide traction to wheels of the wheelchair. Joint 1506*a* and joint 1506*b* are provided along the opposite edges of base plate 1504 for attaching to frame 1502.

Figure 24:
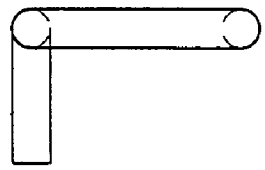
Figure 22:
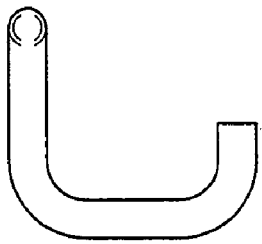
FIG. 22, 23, 24 illustrate a plan view, a side view and a front view of a gripping handle, respectively, in accordance with various embodiments of the present invention.
Figure 23:
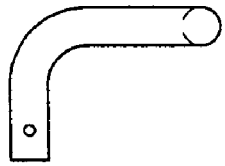

FIG. 22, 23, 24 illustrate a plan view, a side view and a front view of gripping handle 112, respectively, in accordance with various embodiments of the present invention. As shown in FIG. 22, gripping handle 112*a* is bended at an angle of 90 degrees at a bend 2202 and a bend 2204 in the same direction. FIG. 23 shows the side view of gripping handle 112*a*. As shown in FIG. 24, gripping handle 112*a* is in an L-shaped configuration.

Figure 25:
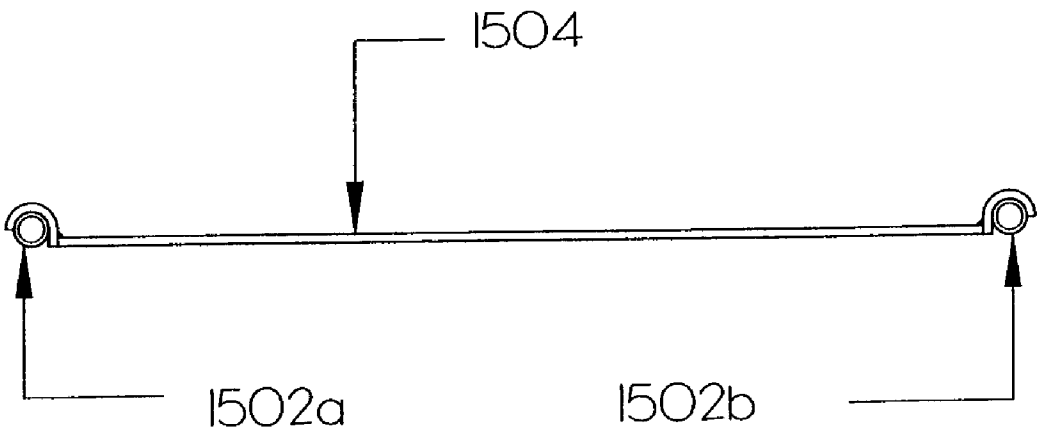
FIG. 25 illustrates a sectional view taken along the section lines 5-5 in FIG. 21 of the base plate, in accordance with the third embodiment of the present invention.

FIG. 25 illustrates a sectional view taken along the section lines 5-5 in FIG. 21 of base plate 1504, in accordance with the third embodiment of the present invention.

Figure 26:
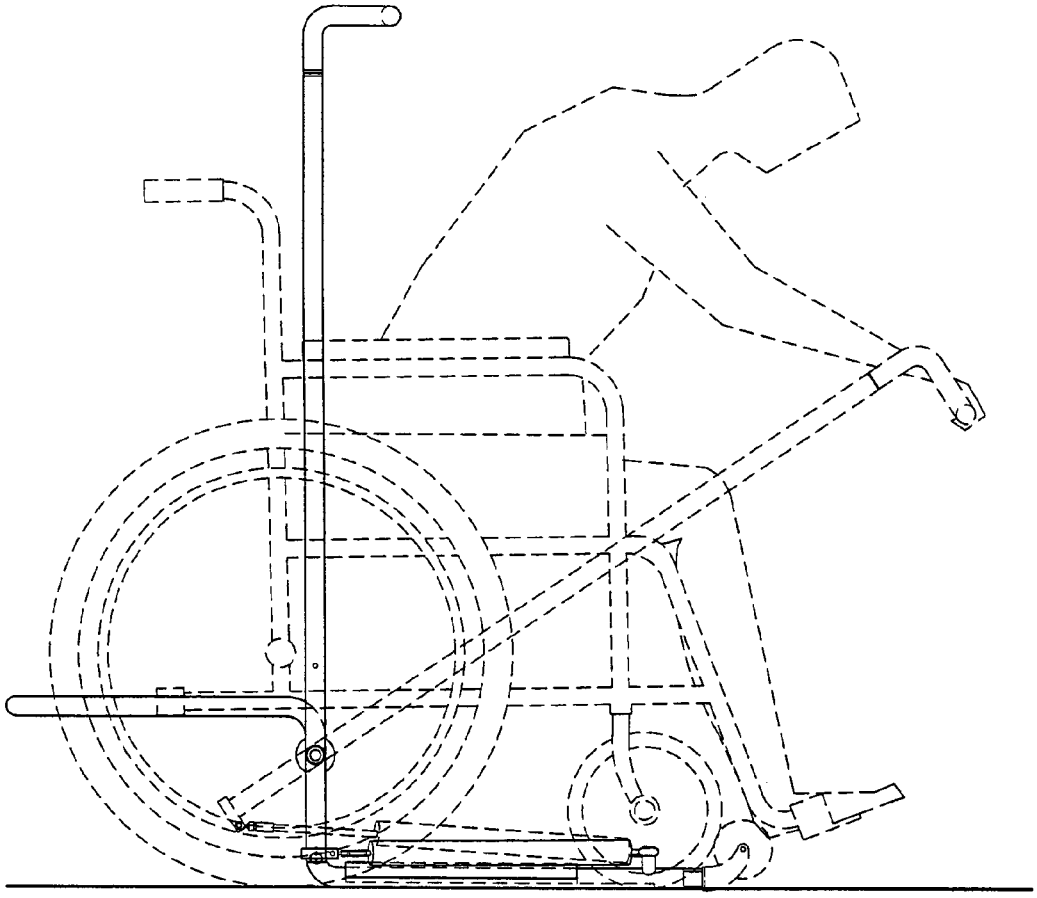
FIG. 26, FIG. 27 and FIG. 28 are side views of the exercising apparatus of FIG. 15, in accordance with the third embodiment of the present invention.
Figure 27:
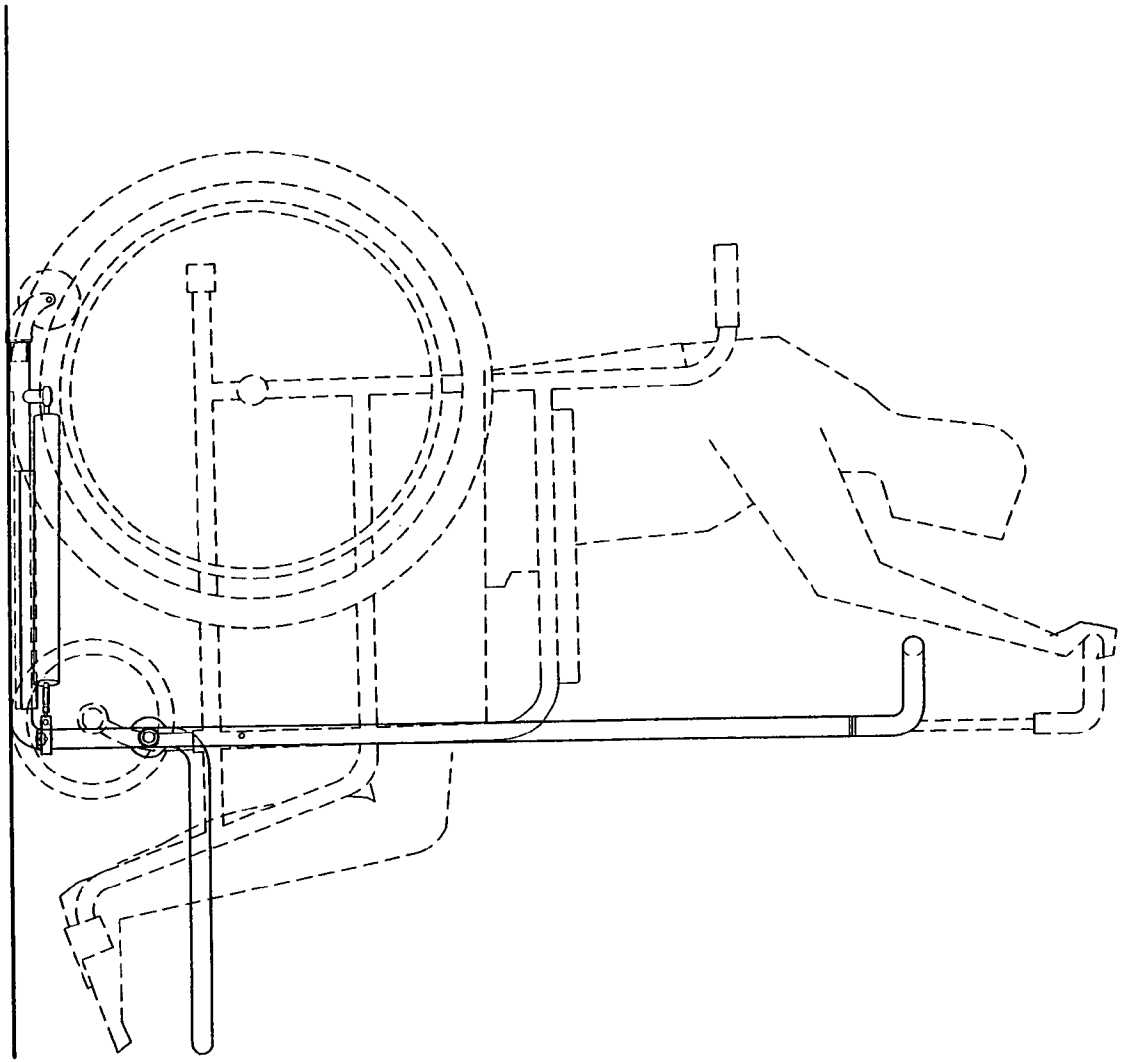
Figure 28:
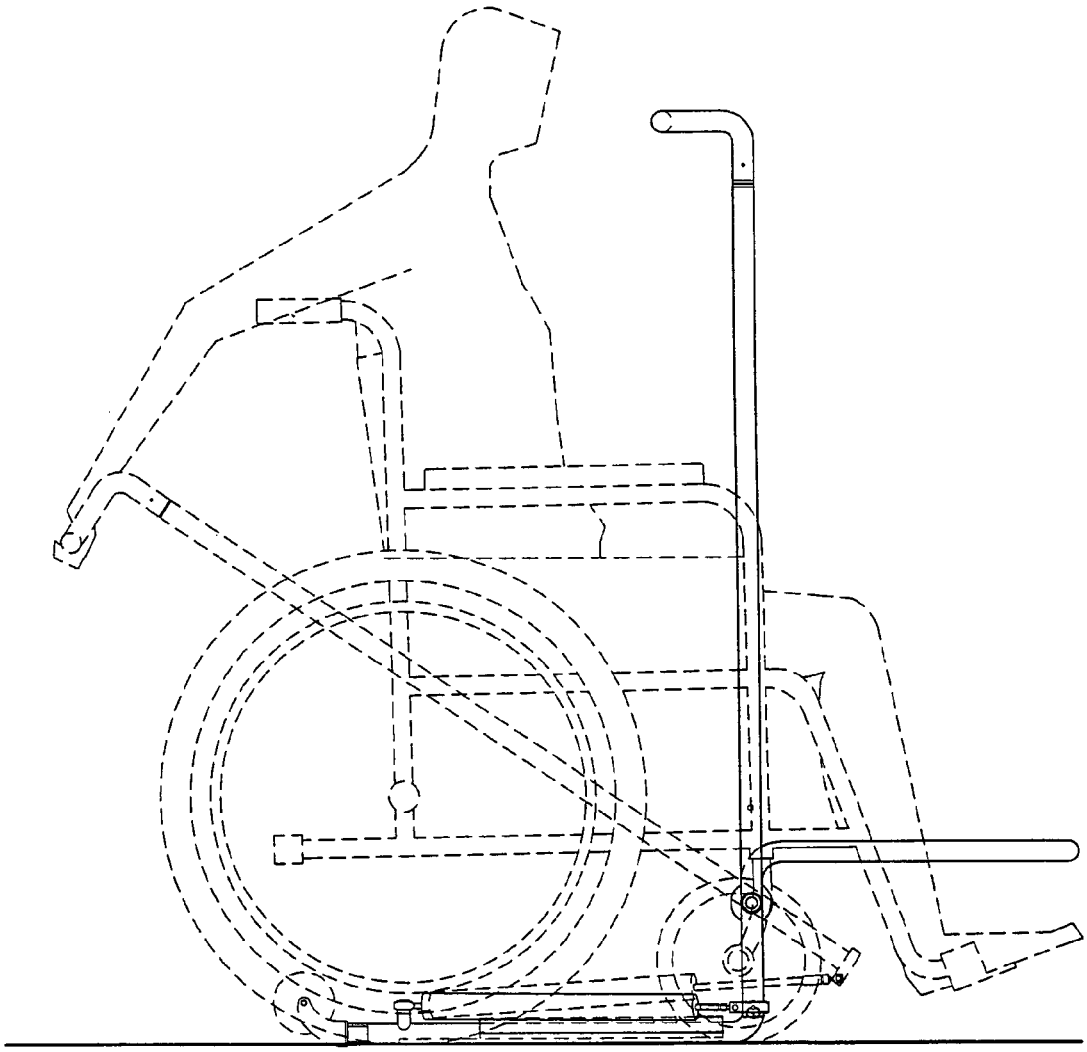

FIG. 26, FIG. 27 and FIG. 28 are side views of the exercising apparatus 1500 of FIG. 15, in accordance with the third embodiment of the present invention. A wheelchair is received into frame 1502. A user sitting on the wheelchair exerts a directional force on gripping handle 112*a* to provide a pivotal motion to arm 106*a*. In an embodiment of the present invention, as shown in FIG. 26, solid lines of arm 106*a* depict a first position of arm 106*a*, while dotted lines of arm 106*a* depict a second position of arm 106*a*.

In an embodiment of the present invention, as shown in FIG. 27, the user exerts a directional force on gripping handle 112*a* to provide a linear axial movement to shaft 701. Solid lines of gripping handle 112*a* depict a first position of gripping handle 112*a*, while dotted lines of gripping handle 112*a* depict a second position of gripping handle 112*a*.

In an embodiment of the present invention, as shown in FIG. 28, a wheelchair is rolled inside frame 1502 in the rearward direction, such that the back of the user faces end frame member 1502*c*. Arm 106*a* is pivotally moved and retracted in a similar manner, as explained in FIG. 26. Shaft 701 is axially moved and retracted in a similar manner, as explained in FIG. 27.

It is to be understood that dimensions, materials, and other aspects of arms 106, frame 104, base plate 1504 and gripping handles 112 are for the convenience of the reader and is not to be construed as limiting. Further, the dimensions, materials, and other aspects of the present invention may be varied substantially within the scope of the invention.

What is claimed is:

1. An exercising apparatus designed to fit around a seat, comprising:

(a) a frame adapted to fit around said seat;

(b) one or more arms pivotally coupled to said frame at one or more pivots, wherein said pivots allow a pivotal motion of each of said arms when a force is exerted thereto by a user;

(c) one or more gripping handles;

(d) one or more shafts coupled to said gripping handles and said arms, wherein said shafts are movable with respect to each of said arms; and (e) one or more first resistance devices coupled to said frame and said arms, wherein said first resistance devices provide resistance to said pivotal motion of each of said arms;

(f) one or more second resistance devices coupled to said shafts and said arms, said second resistance devices providing resistance to said movement of each of said shafts.

2. The exercising apparatus according to claim 1, wherein said frame is mounted through one or more levelers.

3. The exercising apparatus according to claim 1, wherein said frame is adapted to be attached to a wall.

4. The exercising apparatus according to claim 1, wherein said frame is adapted to be attached to said seat.

5. The exercising apparatus according to claim 1, further comprising a base member adapted to be placed under said seat and secured in place by the weight of the user.

6. The exercising apparatus according to claim 1, wherein said seat is selected from a group consisting of a chair and a toilet seat

7. The exercising apparatus according to claim 1, further comprising a bearing arrangement between said shafts and said arms.

8. The exercising apparatus according to claim 1, further comprising one or more first retracting devices attached to said first resistance devices, wherein said first retracting devices provide retraction to said pivotal motion of each of said arms

9. The exercising apparatus according to claim 8, wherein said first retracting devices are one or more springs.

10. The exercising apparatus according to claim 9, wherein at least one of said first resisting devices includes a hydraulic damper.

11. The exercising apparatus according to claim 1, further comprising one or more second retracting devices attached to said second resistance devices, wherein said second retracting devices provide retraction to said movement of each of said shafts.

12. The exercising apparatus according to claim 11, wherein said second retracting devices comprises one or more springs.

13. The exercising apparatus according to claim 12, wherein at least one of said second resisting devices includes a hydraulic damper.

14. An exercising apparatus designed to fit around a seat, comprising:

(a) a frame adapted to fit around said seat;

(b) one or more arms pivotally coupled to said frame at one or more pivots, wherein said pivots allow a pivotal motion of each of said arms based on a force exerted by a user;

(c) one or more first resistance devices, coupled to said frame and said arms, which provide resistance to said pivotal motion of each of said arms; and (d) one or more first retracting devices, attached to said first resistance devices, which provide retraction to said pivotal motion of each of said arms;

wherein at least one of the resistance devices comprises damping means and at least one of the retracting devices comprises at least one spring.

15. An exercising apparatus designed to fit around a seat, said exercising apparatus being adapted to be attached to a support and comprising, in combination:

(a) a frame adapted to fit around said seat and adapted to be secured to the support;

(b) one or more arms pivotally coupled to said frame at one or more pivots, wherein said pivots allow a pivotal motion of each of said arms when a force is exerted thereto by a user;

(c) one or more gripping handles;

(d) one or more shafts coupled to said gripping handles and said arms, wherein said shafts are movable with respect to each of said arms;

(e) one or more second resistance devices coupled to said shafts and said arms, wherein said second resistance devices provide resistance to said movement of each of said shafts;

(f) one or more first resistance devices coupled to said frame and said arms, wherein said first resistance devices provides resistance to said pivotal motion of each of said arms;

(g) one or more first retracting devices attached to said first resistance devices, wherein said first retracting devices provide retraction to said pivotal motion of each of said arms;

(h) one or more second resistance devices coupled to said shafts and said arms, wherein said second resistance devices provide resistance to said movement of each of said shafts; and (i) one or more second retracting devices attached to said second resistance devices, wherein said second retracting devices provide retraction to said movement of each of said shafts.

16. The exercising apparatus according to claim 15, wherein said frame is mounted through one or more levelers.

17. The exercising apparatus according to claim 15, wherein said support is a wall.

18. The exercising apparatus according to claim 15, wherein said support is said seat.

19. The exercising apparatus according to claim 15, wherein said support is a base member adapted to be placed under the seat and secured in place by the weight of the user.

20. The apparatus of claim 19, wherein the seat is a wheelchair

21. The exercising apparatus according to claim 15, wherein said seat is selected from a group consisting of a chair and a toilet seat.

22. The exercising apparatus according to claim 15, wherein said first retracting devices are one or more springs.

23. The exercising apparatus according to claim 15, wherein said second retracting devices are one or more springs.

* * * * *